United States Patent [19]

Gilbert

[11] 4,248,350

[45] Feb. 3, 1981

[54] CORNER POST WITH INTEGRAL LOCK

[75] Inventor: Earl F. Gilbert, Farmington Hills, Mich.

[73] Assignee: Westvaco Corporation, New York, N.Y.

[21] Appl. No.: 86,730

[22] Filed: Oct. 22, 1979

[51] Int. Cl.[3] ..... B65D 81/02

[52] U.S. Cl. ..... 206/586; 206/320; 229/93

[58] Field of Search ..... 206/586, 320, 326; 220/441; 229/93, DIG. 1

[56] References Cited

U.S. PATENT DOCUMENTS

| | | | |
|---|---|---|---|
| 1,916,519 | 7/1933 | Madsen et al. | 229/93 X |
| 2,609,136 | 9/1952 | Sider | 206/586 X |
| 2,861,681 | 11/1958 | Lane | 206/586 X |
| 3,072,313 | 1/1963 | Svendsen . | |
| 3,199,765 | 8/1965 | Locke | 229/93 X |
| 3,613,985 | 10/1971 | Goodsite | 229/DIG. 1 |
| 3,734,389 | 5/1973 | Brown | 229/DIG. 1 |
| 3,982,682 | 9/1976 | Fremion | 206/320 |
| 4,027,817 | 6/1977 | Fremion | 206/320 |

*Primary Examiner*—Stephen P. Garbe

[57] ABSTRACT

The corner post of the present invention is constructed from a one piece blank of cut and scored corrugated paperboard that includes an integral locking means for securing the corner post in its usable condition. The corner post blanks are normally shipped and stored in a flat condition, and are folded into a generally quadrilateral cross sectional shape for use. When so folded, one or more pairs of locking tabs and ears, that are formed integrally with the blank, are engaged to lock the corner post in its quadrilateral shape.

1 Claim, 3 Drawing Figures

CORNER POST WITH INTEGRAL LOCK

BACKGROUND OF INVENTION

The present invention relates to the field of packaging, and more particularly, it relates to a corner post construction that is formed at the point of use from a one piece blank of material such as corrugated paperboard. The improvement in the invention resides in the manner in which the blank is cut and scored to produce a final configuration that is generally of quadrilateral shape in cross section, the inclusion of a diagonally oriented bracing member, and the use of an integral frictional locking means for retaining the corner post in its usable condition.

It is conventional practice in the packaging of heavy and bulky appliances, such as refrigerators, driers, washing machines and the like, to use cushioning elements in the corners of the shipping containers to protect the appliances from damage during shipping and storage. In addition, such cushioning elements are also used to protect the upper and lower edges of the packaged products during shipment. Moreover, because the vertical stacking strength of the containers generally used for packaging such products is not very great, the cushioning elements also serve to provide increased overall strength to the shipping containers particularly when the containers are stacked high, either in a transportation vehicle or a warehouse. Thus, when provided at the corners, top and bottom of shipping containers, the cushioning elements provide excellent stacking strength, and because they provide a space between the side walls of the container and the packaged product, damage from external sources is also substantially reduced.

DESCRIPTION OF PRIOR ART

Cushioning members such as corner posts are well known in the art. Generally such corner posts are prepared from wood or multiple thicknesses of paperboard such as corrugated paperboard which is cut and scored to provide the desired final shape. Some corner post constructions are formed by the manufacturer and shipped in bulk to the user, while others may be formed at the point of use. Examples of corner posts that are pre-formed are shown in U.S. Pat. Nos. 3,072,313 and 3,734,389. Meanwhile, U.S. Pat. Nos. 3,613,985; 3,982,682; and, 4,027,817 each disclose corner post constructions that are formed at the point of use. In each of the cases disclosed in the aforementioned prior art patents, the corner posts when formed assume a generally right angle configuration in cross section. In contrast to these prior art constructions, the corner post of the present invention is generally of quadrilateral shape in cross section, and it is reinforced by an additional diagonally oriented bracing panel that extends between two corners of the quadrilateral. Moreover the corner post disclosed herein also includes a novel friction panel lock for retaining the corner post in its set up condition without the need for adhesives, staples or other securing means.

SUMMARY OF INVENTION

Figure 1:
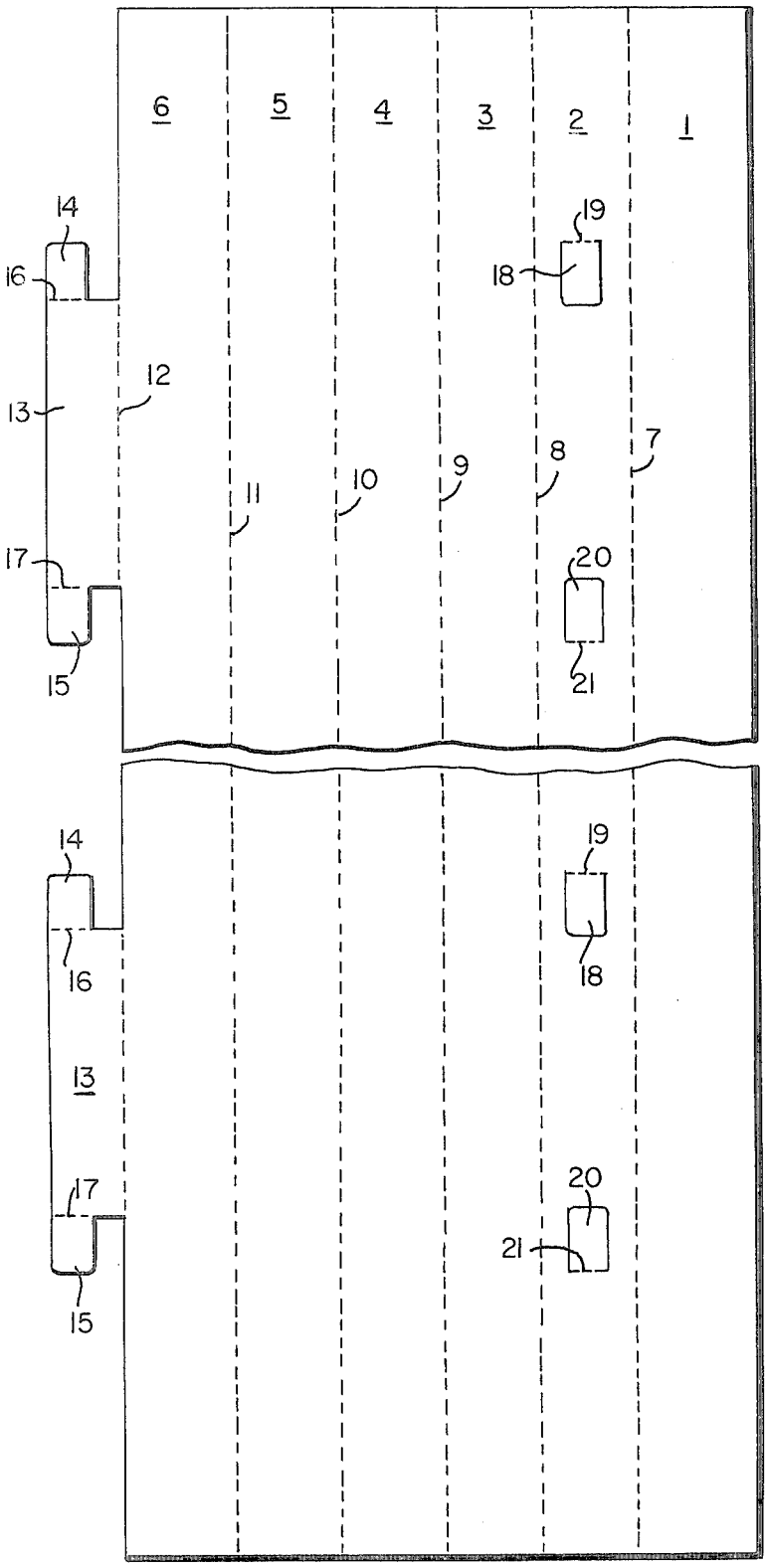
FIG. 1 shows in plan a typical blank structure for use in constructing the corner post of the present invention.

The corner post of the present invention is prepared from a single blank of corrugated paperboard or the like with a minimum of folding steps and without the use of adhesives, staples, tape or other securing means. The blank is cut and scored by the manufacturer in a die press or the like to provide the panels and self locking elements used to form and lock the various panels in their corner post configuration.

Corrugated paperboard is the preferred blank material, and generally the blank is formed from several layers of paperboard, i.e., corrugated medium and linerboard, to produce a structure of adequate strength. The corrugated material may consist of the same material used for forming the shipping containers in which the corner posts are used, or for severe climatic conditions, the corrugated material may be treated with a suitable moisture barrier compound which resists the penetration of moisture, vermin or other deleterious matter.

In the preferred embodiment, the corner post blank is generally of rectangular configuration with parallel top and bottom edges and opposed side edges, one of which includes part of the means for locking the corner post in its usable configuration. The blank is further divided from side-to-side by a series of substantially parallel fold lines into a plurality of major panels. Meanwhile, one of the major panels also includes the remaining part of the self locking means for the corner post. Thus, while six major panels are disclosed in the preferred embodiment, it will be understood that the corner post could be constructed from a minimum of four panels if the additional reinforcing panels were omitted. Each of the panels is of substantially the same width except where the panels overlap one another, and in the case of the diagonal reinforcing panel which must be of a width great enough to extend between the diagonal corners of the quadrilateral.

In other respects, the corner post blank also includes at one side edge a plurality of locking flaps that are spaced from one another and which include paired locking ears at each end thereof. The locking flaps are adapted to overlap one of the major panels of the corner post blank where the paired locking ears for each locking flap become frictionally engaged within cooperating locking means formed in the underlying major panel. For this purpose, the underlying major panel is provided with partially cut out locking tabs that remain attached to the panel along scored fold lines. With this arrangement, when the preferred six panel configuration is folded into its quadrilateral corner post form, two panels become overlapped, another panel becomes oriented inside the quadrilateral, and the locking flaps are folded over the panel which has the locking tabs cut therein so that the ears on the locking flaps can be inserted in the space formed by the locking tabs for securing the corner post together. In this manner, the corner post remains in its erected condition as a result of the novel external frictional locking scheme provided therefor in the blank structure.

Accordingly, the corner post of the present invention remains in its flat, unfolded condition for shipment to the point of use where the panels are readily and easily folded and locked in the erected condition for use. Once the fully formed corner posts are inserted in the shipping container between the container walls and the packaged product, they provide a void space around the product which protects it from external damage, and they provide increased vertical stacking strength to the container.

DETAILED DESCRIPTION

Referring to the drawings, particularly FIG. 1, there is illustrated a blank of foldable sheet material such as multi-ply layers of corrugated paperboard, that can be used to fabricate the corner post of the present invention. The blank is of substantially rectangular configuration and is divided into a plurality of major panels 1, 2, 3, 4, 5 and 6 by a series of parallel fold lines 7, 8, 9, 10 and 11. The fold lines are preferably applied to one face of the blank to facilitate the folding sequence of the blank. In addition, the blank structure includes means for securing the panels in their corner post configuration. For this purpose, a plurality (two shown) of locking flaps 13 are foldably attached to an edge of panel 6 along fold lines 12. The locking flaps each include a main portion with ears 14 and 15 located at each end thereof and attached thereto along scored fold lines 16,17 respectively. Meanwhile, cooperating locking means are provided in one of the major panels 3 in the form of locking tabs 18,20. The locking tabs 18,20 are in the form of flaps, that are cut from the panel 3 but remain attached thereto along scored fold lines 19,21 respectively. It is of particular significance that the scored fold lines 19,21 of the locking tabs 18,20 are located oppositely from the scored fold lines 16,17 of locking ears 14,15. That is, considering locking ear 14 and locking tab 18, for instance, it will be noted that while both fold inside the corner post structure the hinges are located on opposite sides so that the ear 14 engages the free edge of tab 18 and is frictionally engaged therein. Thus, during the manufacture of the blank, the locking tabs 19,20 must be precisely located in panel 3 such that the fold lines 16,17 of locking ears 14 and 15 are aligned from side-to-side with the free edges of locking tabs 18 and 20. The location of the fold lines 19,21 of locking tabs 18 and 20 is not as critical but they are generally aligned with the free edges of locking ears 14,15 for good results. Accordingly, when the corner posts are formed, the locking flaps 13 are folded over the panel 3 and the locking ears 14,15 are folded downwardly about their fold lines 16,17 for insertion behind the locking tabs 18,20. However, because of the orientation of the free edges of tabs 18,20 with the scored lines 16,17 of locking ears 14,15, when the locking ears are inserted in the tabs 18,20, the free edges thereof are only slightly displaced and because of their natural tendency to return to a normal undisplaced position, the tabs 18,20 act as a positive frictional lock to retain the locking ears 14,15 in place.

Figure 2:
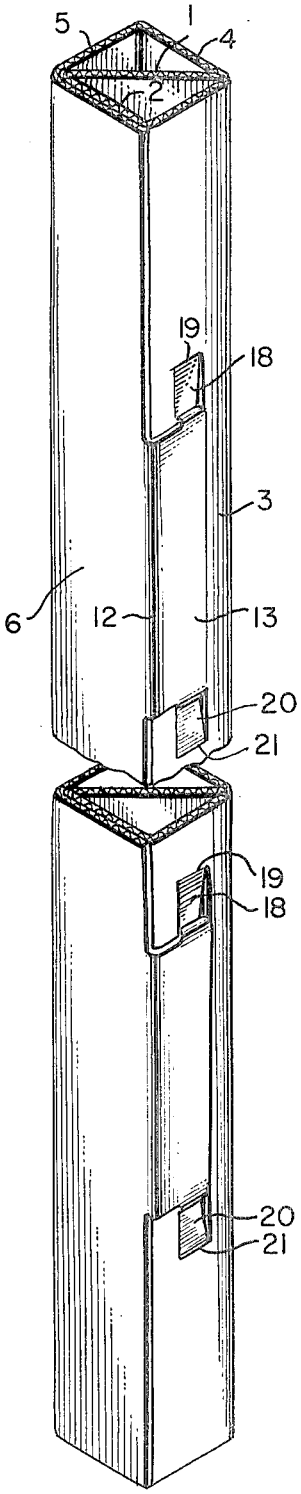
FIG. 2 is a partial perspective view of the formed corner post showing the means for locking the panels together; and, FIG. 3 is an end view in cross section of the formed corner post.
Figure 3:
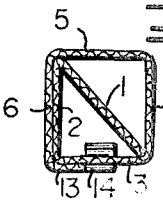

As noted hereinbefore, the corner post blanks are shipped to the user in their flat, unfolded condition. At the point of use the blanks are folded into the condition shown in FIG. 2. For this purpose, panels 2, 3, 4 and 5 are squared to form a quadrilateral cross sectional structure. At this point, panel 1 becomes oriented in a diagonal position between two opposed corners of the quadrilateral structure. Panel 1 thus serves as an additional reinforcing element to keep the quadrilateral from collapsing and to provide extra compression strength for stacking. At this point, panel 6 overlaps panel 2 and the locking flaps 13 overlap panel 3 where the locking ears 14,15 are engaged with the locking tabs 18,20. FIGS. 2 and 3 show how the locking ears 14 and 15 are inserted within the cut outs in panel 3 formed by the locking tabs 18 and 20. Note that the scored lines 19,21 are displaced or offset from the entry point of the ears 14,15 into the cut outs. In this manner, the locking tabs 18,20 are only slightly displaced so that their free edges tend to provide a good frictional hold for the locking ears 14,15.

The blank is preferably die cut and scored in sheet form and shipped to the user in flat condition for final assembly. At the point of use the blanks are simply folded into final form and locked. The blanks are generally cut to the desired length by the manufacturer and are provided with a sufficient number of locking flaps to keep the corner post erected, but not so many that the corner post is unduly weakened. Accordingly, it may be seen that a novel self locking corner post structure has been disclosed for safely and securely packaging products in a suitable shipping container. Thus, while only one embodiment has been fully disclosed herein, it will be understood by those skilled in the art that modifications may be made without departing from the spirit and scope of the invention as defined in the appended claims.

I claim:

1. A corner post blank constructed from a sheet of foldable material that is normally stored and shipped in a flat condition and when erected into its corner post configuration assumes a quadrilateral cross sectional configuration, said blank comprising:

(a) a substantially rectangular piece of foldable material having parallel top and bottom edges and opposed side edges, said piece of material being scored longitudinally along parallel fold lines to produce a plurality of discrete major panels of substantially the same width and length, at least four of said panels being adapted to form the quadrilateral structure, another of said panels being adapted to form a diagonally oriented full length reinforcing means and another of said panels being adapted to overlap one of said four quadrilateral panels; and, (b) an external locking means integral with said blank for locking the panels in their corner post configuration, said locking means comprising a plurality of locking flaps foldably attached along an edge of one of said discreet panels, locking ears foldably attached to each end of each locking flap along first, transversely extending scored fold lines, and a plurality of cooperating locking tabs formed in another of said discreet panels which are connected thereto along second, transversely extending scored fold lines that are longitudinally offset from said first fold lines, the improvement wherein the first scored fold lines are aligned from side-to-side on the blank with the leading edges of said locking tabs.

* * * * *